United States Patent [19]

Buxbaum

[11] Patent Number: 4,752,713

[45] Date of Patent: Jun. 21, 1988

[54] THERMIONIC CATHODE OF HIGH EMISSIVE POWER FOR AN ELECTRIC TUBE, AND PROCESS FOR ITS MANUFACTURE

[75] Inventor: Charley Buxbaum, Baden, Switzerland

[73] Assignee: BBC Brown, Boveri & Company Limited, Baden, Switzerland

[21] Appl. No.: 23,917

[22] Filed: Mar. 5, 1987

Related U.S. Application Data

[63] Continuation of Ser. No. 654,027, Sep. 25, 1984, abandoned.

[30] Foreign Application Priority Data

Sep. 30, 1983 [CH] Switzerland ..... 5320/83

[51] Int. Cl.[4] ..... H01J 1/14

[52] U.S. Cl. ..... 313/346 R; 313/346 DC; 313/337; 252/514

[58] Field of Search ..... 313/346 R, 346 DC, 270, 313/345, 337, 336; 252/514

[56] References Cited

U.S. PATENT DOCUMENTS

| | | | |
|---|---|---|---|
| 3,684,912 | 8/1972 | Cheney et al. | 313/346 R |
| 4,019,081 | 4/1977 | Buxbaum et al. | 313/346 R |
| 4,274,030 | 6/1981 | Buxbaum | 313/346 R |
| 4,291,252 | 9/1981 | Aida et al. | 313/346 R |
| 4,310,777 | 1/1982 | Fukushima et al. | 313/346 R |
| 4,393,328 | 7/1983 | Shroff et al. | 313/346 DC |
| 4,429,250 | 1/1984 | Clerc et al. | 313/346 R |
| 4,533,852 | 8/1985 | Frank et al. | 313/346 DC |

FOREIGN PATENT DOCUMENTS

| | | | |
|---|---|---|---|
| 0024982 | 6/1981 | Japan | 313/346 R |
| 0133739 | 8/1983 | Japan | 313/346 R |

*Primary Examiner*—David K. Moore
*Assistant Examiner*—Michael Razavi
*Attorney, Agent, or Firm*—Oblon, Fisher, Spivak, McClelland & Maier

[57] ABSTRACT

A reactionless thermionic cathode for electronic tubes consists of a metallic or ceramic support and an alloy, preferably an intermetallic compound, containing the actual emission-promoting element, with a metal from the group comprising those of the VIIIth vertical row of the periodic table and rhenium. The preferred activation substances are platinides of the elements having a low electron work function, predominantly Ba and La. The cathode is manufactured by wet-mechanical, cataphoretic or electroplating application of the activation substance to the support or by infiltration of the porous support having a pore volume of at least 10%. High emission current densities are obtained at relatively low operating temperatures.

15 Claims, No Drawings

THERMIONIC CATHODE OF HIGH EMISSIVE POWER FOR AN ELECTRIC TUBE, AND PROCESS FOR ITS MANUFACTURE

This application is a continuation of application Ser. No. 654,027, filed on Sept. 25, 1984, now abandoned.

The invention starts from a thermionic cathode for an electronic tube according to the generic type of the preamble of claim 1, and from a process for its manufacture according to the generic type of the preamble of claim 10.

Thermionic cathodes for electronic tubes are known in numerous types of function and combinations of material. For low powers, high-yield barium oxide cathodes have been frequently used. As high-power cathodes, the thoriated tungsten cathodes ($ThO_2/W_2C/W$ system), belonging to the reduction-dispensation type, with or without further additives are employed above all. Amongst the homogeneous single-phase cathodes, the sub-groups of single-component and multi-component cathodes can be distinguished. The latter include inter alia the cathodes consisting of a chemical compound, for example TiC, ZrC, TiSi or $LaB_6$, and the alloy cathodes. See "Tungsten-Osmium Alloys for Improved Cathodes", Platinum Metals Review, Volume 26, January 1982, No. 1; "Thermoemissive Properties of (100) Faces of Single Crystals of Solid Solutions of Iridium, Osmium and Rhenium in Tungsten", N. B. Smirnova, B. G. Smirnov, S. M. Mikahilov and G. B. Shuppe, Soviet Physics—Solid State, Volume 12, No. 4, October 1976; "Thermionic Emission Properties of Metal Alloys (Survey)", T. L. Matskevich, Soviet Physics—Technical Physics, Volume 13, No. 3, September 1968; "Austrittsarbeit von Legierungen Nb-Ta, Ti-Re, Ta-Re [Work function of Nb-Ta, Ti-Re and Ta-Re alloys]", Radiotechnika: Elektronika No. 11, 1964, Moscow.

All the cathodes giving high emission current densities (thoriated tungsten cathode, lanthanum hexaboride cathode) work at high operating temperatures (1,700 to 2,000 K), which is close to the limits of permissible mechanical stresses. Since the heat resistance of the materials used cannot be increased much further, the constructional and process engineering expense in the production of thermionic cathode vessels is considerable. In particular, lanthanum hexaboride cannot be brought into all the possible and desirable geometrical shapes, due its brittleness.

There is therefore a need for an improvement in the conventional thermionic cathodes and for an increase in the operational reliability and service life, while at the same time lowering the operating temperature.

The invention is based on the object of indicating a thermionic cathode of high emissive power, and a process for its manufacture, which cathode has, with high emission current density in continuous operation, a long service life and high heat resistance, consists of easily processable material of the highest possible ductility, does not tend to embrittlement and can be produced in a simple manner in any geometrically appropriate shape. In particular, it should be possible to produce the thermionic cathode in the form of thin wires and wire meshes as a shock-proof structure. At the same time, the operating temperature should be as low as possible.

This object is achieved by the features indicated in the characterising clauses of claims 1 and 9.

The fundamental characterising feature of the novel thermionic cathode is that the activation substance promoting the electron emission is of metallic character, both as a stock and as an emissive surface layer, and can be present in principle on any desired support. Thus, there are no chemical reactions or thermal decompositions of a non-metallic substance taking place. This makes it possible to accommodate a virtually unlimited quantity of activation substance on the support or in the support. Moreover, in the case of a metallic support, this material allows further processing, virtually without any problems, to give thin wires, strips and sheets. In contrast thereto, however, the proposed system also enables the activation substance to be accommodated on or in a ceramic support, if this leads to particular advantages. In this case, the support must of course be brought beforehand into the final shape.

The invention is described by reference to the illustrative embodiments which follow.

Illustrative embodiment I

An alloy of barium and platinum was used as the activation substance. In the present case, this is barium platinide $BaPt_5$. Weighed quantities of barium and platinum were fused in the correct stoichiometric ratio in an arc furnace under an inert gas blanket of argon. The melt was cooled, caused to solidify and comminuted in a mortar. The fragments were ground to a powder of a maximum particle size of 1 $\mu$m in a ball mill with tungsten carbide lining and tungsten carbide balls. The powder was then stirred up with nitrocellulose and amyl acetate to give a mobile paste. This suspension was applied to a tungsten wire of 0.5 mm diameter by rolling-on in a layer thickness of 100 $\mu$m, and was dried. The 100 mm long, coated wire was clamped by means of a cathode holder into a thermionic cathode vessel, and the latter was evacuated down to a residual gas pressure of less than $10^{-4}$ mbar. The wire was slowly heated to a temperature of about 800 K, the nitrocellulose being decomposed and the decomposition products leaving the reaction space. After a holding time of 20 minutes, the vacuum was taken to a residual gas pressure of less than $10^{-5}$ mbar, and the wire was heated further to a temperature of 1,400 K. After an activation period of 15 minutes, the full steady emission current density of 4 A/cm$^2$ was reached and maintained. the cathode proved to be hardly vacuum-sensitive. It was possible to maintain the emission current density of 4 A/cm$^2$ unchanged in continuous operation, even if the vacuum deteriorated to a residual gas pressure of about $3\times10^{-4}$ mbar. In the course of the first operating period, the formation of the platinide $BaPt_2$, richer in barium, in addition to free platinum was to be observed on the cathode surface. Evidently, a new chemical-thermodynamic equilibrium state was established, which then persisted unchanged over the entire operating period until the activation substance was exhausted. This had no influence on the obtainable emission current density.

ILLUSTRATIVE EMBODIMENT II

In accordance with Example I, an alloy corresponding to the intermetallic compound $BaPt_2$ was first smelted, cooled, caused to solidify, crushed in a mortar and ground to a fine-grain powder in a ball mill. This powder was then slurried to a fine dispersion in a suitable bath and was applied cataphoretically to a molybdenum wire of 0.5 mm diameter in a layer thickness of 50 $\mu$m. The coated wire was subsequently subjected under an argon atmosphere for 10 minutes to a heat treatment at a temperature of 1,400° C., the $BaPt_2$ particles being firmly bonded to the support and to one another by sintering. Surface layers of any desired thickness can be obtained by alternating cataphoretic deposition and sintering treatment. The essential point is that contact with air is avoided as far as possible, since $BaPt_2$ is not corrosion-resistant and decomposes into BaO+Pt. The coated molybdenum wire was tested as a thermionic cathode and gave a steady emission current density of 4 A/cm$^2$ at a temperature of 1,400 K.

ILLUSTRATIVE EMBODIMENTS III

Analogously to Example I, an alloy of lanthanum and platinum was used. In this case, this was the lanthanum platinide $LaPt_2$. Corresponding stoichiometric quantities of lanthanum and platinum were fused together in an arc furnace under an argon atmosphere and, after solidification of the melt, were comminuted in a mortar and ground to a fine-grain powder. This was applied to a tungsten wire with the aid of nitrocellulose and amyl acetate, in exactly the same way as described in Example I. The coated wire was degassed for 20 minutes at a temperature of about 800 K and under a residual gas pressure of less than $10^{-4}$ mbar. The residual gas pressure of the vacuum was then lowered to a value of less than $10^{-5}$ mbar and the temperature of the wire was increased to 1,850 K. After an activation period of 10 minutes, an emission current density of 5.5 A/cm$^2$ was reached in the thermionic cathode vessel. This value was also maintained without drop in steady continuous operation.

ILLUSTRATIVE EMBODIMENT IV

The activation substance was an alloy of barium and palladium, which corresponded approximately to the composition of the intermetallic compound $BaPd_5$. It was smelted by mixing the components in an arc furnace under an argon atmosphere. An open-pored round bar of 10 mm diameter and having a pore volume of 25% was prepared from molybdenum by a powder-metallurgical method. The molybdenum body was, together with the molten Ba/Pd alloy, introduced into a vacuum-tight casting device and brought to a temperature of 1,700° C. After a residence time of 15 minutes in vacuo, the casting device was flooded with argon of 10 bar pressure and the temperature was maintained for 30 minutes. During this time, the Ba/Pd alloy infiltrated the porous molybdenum body and completely filled its pores. After cooling, the bar was turned cylindrically along the outside and heated again to 1,100° C. A number of hot-forming operations with heating in between was then carried out under an inert gas blanket; this consisted in swaging and drawing to give a wire of 0.8 mm diameter. The finished molybdenum wire doped with the Ba/Pd alloy was inserted into a thermionic cathode vessel and operated at a temperature of 1,350 K under a vacuum of a residual gas pressure of $10^{-4}$ mbar. In continuous operation, a steady emission current density of 2 A/cm$^2$ was measured. After some time, the formation of $BaPd_2$ was to be observed on the cathode surface. This chemical change remained without influence on the emission current density. Since, however, $BaPd_2$ has a substantially lower melting point than $BaPd_5$, care must be taken that, in view of the large relative quantity of the activation substance, the electronic tube is not operated at an unduly high cathode temperature. On the other hand, such a thermionic cathode is distinguished by a considerable stock of activation substance and, correspondingly, a long service life.

ILLUSTRATIVE EMBODIMENTS V

The activation substance selected was an alloy of barium and ruthenium, which approximately corresponded to the intermetallic compound $BaRu_2$. The alloy was smelted from the components in vacuo in an induction furnace and caused to solidify. The support consisted of a porous hollow cylinder of sintered zirconium oxide stabilised with yttrium oxide and having an external diameter of 12 mm and an internal diameter of 6 mm. The pore volume of the open-pored sintered body was 30%. The latter was packed on all sides into the powdered activation substance, and the whole was introduced into a vacuum vessel and heated inductively to 2,000° C. The Ba/Ru alloy thus melted and penetrated into the pores of the sintered body. To improve the penetration, the vessel was additionally flooded with argon under a pressure of 10 bar for 20 minutes. After the infiltrated sintered body had cooled down, it was lightly turned cylindrically on the outside and inside, in order to remove adhering alloy residues. In addition, a 5 μm thick ruthenium layer was applied to the outer surface by electroplating, in order to bridge the non-metallic surface portions bounded by the sintered body. Subsequently, the whole was heated for 1 hour at a temperature of 1,500° C. in vacuo. The cathode, provided in the interior with a tungsten coil for heating, was installed in an electronic tube and operated under a vacuum of $10^{-5}$ mbar residual gas pressure at a temperature of 1,500 K. In continuous operation, a steady emission current density of 10 A/cm$^2$ was then measured.

The invention is not restricted to the illustrative embodiments. In principle, the support can consist of a heat-resisting metallic or ceramic body having a pore volume of 10 to 50%, the pores of which are completely filled with the activation substance. Suitable supports are in particular the refractory metals W, Mo, Ta and Nb or alloys of at least two of these metals. They have the advantage that they are ductile and, as structural materials, can be processed into any desired shapes, for example as wire, strip, sheet and the like. Moreover, ceramic materials of high melting point, such as, for example, $ZrO_2$ stabilised with $Y_2O_3$, can be used. Alloys of the metals from the group comprising those of the VIIIth vertical row of the periodic table and rhenium, and of an element having a low electron work function, that is to say of less than 3 eV, can be used as the activation substance. The alloy components therefore include, on the one hand, the iron metals, above all nickel, and the platinum metals, above all platinum, and, on the other hand, the elements Ba, Ca, La, Y, Gd, Ce, Th, U and the like. The platinides of Ba and/or La, including $BaPt_5$ and/or $BaPt_2$ or $LaPt_5$ and/or $LaPt_3$ and/or $LaPt_2$ have proved to be particularly advantageous. The alloys concerned can also be mixed, that is to say there can be several of them. However, at least one of the abovementioned alloys and/or intermetallic compounds should be present as the activation substance.

The activation substance used as the alloy and/or intermetallic compound is applied to the support either by a wet-mechanical method (application as a paste with suitable chemical substances, or cataphoresis) or by chemical means (for example electroless deposition, co-precipitation and the like) or by electroplating and then forms the edge zone of the thermionic cathode body. Another method comprises infiltrating the activation substance by fusion metallurgy, that is to say in the liquid state, into the porous support (open-pored body), a body of a uniform structure across the entire cross-section being obtained as the thermionic cathode. The infiltrated body can subsequently be subjected to hot-forming by extrusion, swaging, drawing or rolling, if a ductile material is used as the support. The two methods can also be used in combination.

The advantages are the comparatively simple manner of manufacture and the low operating temperature of the cathode (in particular for barium alloys as the activation substance) and, at the same time, the long service life (large stock of activation substance) as compared with conventional cathodes.

I claim:

1. A thermionic cathode of high emissive power for an electronic tube, consisting of a heat-resisting metallic or ceramic body serving as a support and of a metallic activation substance which promotes the emission of electrons, said activation substance consisting of at least one alloy, intermetallic compound, or mixtures thereof of a metal selected from the group consisting of the metals of the VIII vertical row of the Periodic Table and rhenium, and of an element selected from the group consisting of Ba, Ca, La, Y, Gd, Ce, Th, and U, and that the activation substance covers the entire surface of the support and fills at least 10% of the total volume of the cathode body.

2. The thermionic cathode of claim 1, wherein said support consists of a coherent porous structure having a pore volume of 10–50%, the pores of which are completely filled with the activation substance.

3. The thermionic cathode of claim 1, wherein the activation substance contains at least one intermetallic compound of a platinum metal with at least one of the elements selected from the group consisting of barium and lanthanum.

4. The thermionic cathode of claim 3, wherein the activation substance contains a platinide of a metal selected from the group consisting of barium, lanthanum, and mixtures thereof.

5. The thermionic cathode of claim 4, wherein said activation substance contains $BaPt_5$, $BaPt_2$ and mixtures thereof.

6. The thermionic cathode of claim 4, wherein said activation substance contains a composition selected from the group consisting of $LaPt_5$, $LaPt_3$, $LaPt_2$ and mixtures thereof.

7. The thermionic cathode of claim 1, wherein the support consists of at least one refractory metal selected from the group consisting of W, Mo, Ta and Nb.

8. The thermionic cathode of claim 7, wherein said support consists of tungsten.

9. The thermionic cathode of claim 1, wherein the support consists of $ZrO_2$ stabilized with $Y_2O_3$.

10. A process for the manufacture of a thermionic cathode of high emissive power for an electron tube of a structure in which a heat-resisting metallic or ceramic body serves as a support and a metallic activation substance is provided thereon, comprising:

applying to or introducing onto said support at least one alloy, intermetallic compound or combination thereof of a metal selected from the group consisting of the metal elements of the group VIII vertical row of the Periodic Table and rhenium and an element selected from the group consisting of Ba, Ca, La, Y, Gd, Ce, Th, and U, said alloy or intermetallic compounds serving as said activation substance.

11. The process of claim 10, wherein said activation substance is applied to said support by a wet-mechanical, chemical, electroplating or fusion-metallurgical process.

12. The process of claim 10, wherein said activation substance is applied to a compact body serving as said support by brushing or cataphoresis.

13. The process of claim 10, wherein said activation substance as a liquid infiltrates the open-pored body which serves as the support and forms a structure which has a pore volume of 10–50%.

14. The process of claim 13, wherein said infiltrated body is subjected to hot-forming by extrusion, swaging, drawing or rolling.

15. The process of claim 10, wherein said heat-resisting body, serving as the support, is produced from at least one refractory metal selected from the group consisting of W, Mo, Ta and Nb, or from an alloy of at least two of said refractory metals, and said activation substance is prepared from a platinide of barium or lanthanum.

* * * * *